US008170427B2

(12) United States Patent
Morita

(10) Patent No.: US 8,170,427 B2
(45) Date of Patent: May 1, 2012

(54) SHEET CONVEYING DEVICE

(75) Inventor: Ryo Morita, Toyokawa (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 513 days.

(21) Appl. No.: 12/362,546

(22) Filed: Jan. 30, 2009

(65) Prior Publication Data

US 2009/0196635 A1 Aug. 6, 2009

(30) Foreign Application Priority Data

Feb. 1, 2008 (JP) ..... 2008-022513

(51) Int. Cl.
*G03G 15/00* (2006.01)

(52) U.S. Cl. ..... 399/21; 399/18

(58) Field of Classification Search ..... 399/21
See application file for complete search history.

(56) References Cited

U.S. PATENT DOCUMENTS

| | | | | |
|---|---|---|---|---|
| 5,024,431 | A * | 6/1991 | Shimizu et al. | 271/263 |
| RE36,301 | E * | 9/1999 | Kai et al. | 399/113 |
| 6,005,593 | A * | 12/1999 | Yoshinaga et al. | 346/134 |
| 6,139,001 | A * | 10/2000 | Buck | 269/136 |
| 6,139,011 | A * | 10/2000 | Huang et al. | 271/274 |
| 6,930,805 | B2 * | 8/2005 | Araki et al. | 358/496 |
| 7,185,888 | B2 * | 3/2007 | Duff et al. | 271/303 |
| 2006/0145414 | A1 * | 7/2006 | Yokobori et al. | 271/258.01 |
| 2007/0296143 | A1 | 12/2007 | Duff et al. | |

FOREIGN PATENT DOCUMENTS

| | | | |
|---|---|---|---|
| JP | 60-056642 | U | 4/1985 |
| JP | 5-16332 | U | 3/1993 |
| JP | 8-323633 | A | 12/1996 |
| JP | 2003-040481 | | 2/2003 |
| JP | 2004-170848 | | 6/2004 |
| JP | 2005-280998 | | 10/2005 |
| JP | 2007-171222 | | 7/2007 |

OTHER PUBLICATIONS

Notification of Reasons for Refusal issued in corresponding Japanese Application No. 2008-022513 dated Nov. 17, 2009, and an English Translation thereof.

* cited by examiner

*Primary Examiner* — Anthony Nguyen
(74) *Attorney, Agent, or Firm* — Buchanan Ingersoll & Rooney PC

(57) ABSTRACT

A sheet conveying device having conveyer rollers for conveying sheets one by one, a jam treater having a space and sheet guides for regulating a front side and a back side of a conveyed sheet. In the space of the jam treater, a sheet is guided, and the jam treater is rotatable and can be drawn out of a housing of the sheet conveying device. The sheet guides have curved portions to form a space in which the jam treater rotates. In order to remove a jammed sheet from a sheet path in the sheet conveying device, an operator rotates the jam treater to wind the jammed sheet around the jam treater and draws the jam treater together with the jammed sheet out of the housing.

11 Claims, 10 Drawing Sheets

SHEET CONVEYING DEVICE

This application is based on Japanese application No. 2008-022513 filed on Feb. 1, 2008, the content of which is incorporated herein by reference.

BACKGROUND OF THE INVENTION

1. Field of the Invention

The present invention relates to a sheet conveying device suited to be employed in an image forming apparatus, such as an electrophotographic copying machine, a printer or the like, or in a finisher for finishing (for example, stapling) sheets ejected from the image forming apparatus.

2. Description of Related Art

In image forming apparatuses, such as copying machines and printers, and in finishers, paper jams are inevitable. In treating such a paper jam, generally, an operator removes the jammed sheet manually. If the jammed sheet is out of the operator's reach, the operator should rotate a conveyer roller by hand to move the jammed sheet. Also, if necessary, the operator should detach a sheet conveying section from the apparatus body so as to make a space for removal of the jammed sheet.

However, if the jammed sheet is wavy, it is difficult to move the sheet by rotating the conveyer roller. Moreover, in order to permit the operator to detach the sheet conveying section from the apparatus body, an excessive space is necessary around the apparatus. Therefore, the apparatus is not convenient to a user who cannot prepare a sufficiently large space for the apparatus.

SUMMARY OF THE INVENTION

An object of the present invention is to provide a sheet conveying device of a simple structure that facilitates a user to remove a jammed sheet.

In order to attain the object, an aspect of the present invention provides a sheet conveying device comprising: a conveyer roller for conveying sheets one by one; a jam treater having a space in which a conveyed sheet is guided, the jam treater being rotatable and being detachable from a device body; and a sheet guide for regulating a front side and a back side of a conveyed sheet, the sheet guide having a bulged portion in which the jam treater is rotatable.

In the sheet conveying device, the jam treater is located in a sheet path, and the jam treater usually serves as a sheet guide. When a paper jam occurs, the jammed sheet is stuck with a part thereof in the space of the jam treater. In this case, an operator rotates the jam treater by hand, and thereby, the jammed sheet is wound around the jam treater. Thereafter, the operator draws the jam treater out of the device body, and thus, the jammed sheet is removed from the device body. After the jammed sheet is peeled off the jam treater, the jam treater is reset in the device body.

BRIEF DESCRIPTION OF THE DRAWINGS

This and other objects and features of the present invention will be apparent from the following description with reference to the accompanying drawings, in which.

DETAILED DESCRIPTION OF THE PREFERRED EMBODIMENTS

Sheet conveying devices according to preferred embodiments of the present invention are described with reference to the accompanying drawings.

Figure 1:
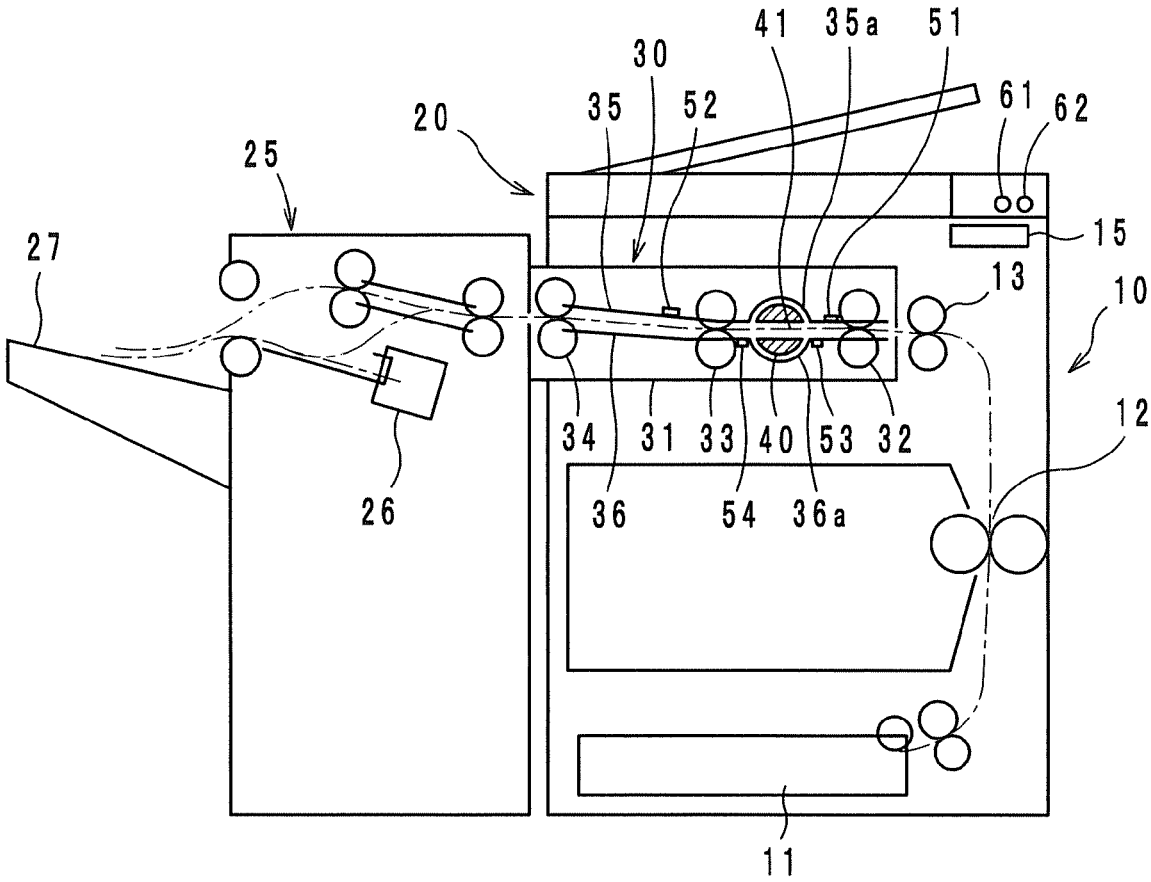
FIG. 1 is a schematic view of an image forming system incorporating a sheet conveying device according to an embodiment of the present invention.

As shown by FIG. 1, an image forming system provided with a sheet conveying device according to an embodiment of the present invention generally comprises a printer body 10, an image reader 20, a finisher 25 having a stapler 26, etc. and a sheet conveying device 30 for conveying printed sheets from the printer body 10 to the finisher 25. The devices other than the sheet conveying device 30 are well known, and descriptions thereof are omitted. In FIG. 1, the long and short dashed line indicates a sheet path. A sheet is conveyed from a sheet feed unit 11 to a transfer section 12, and then onto a tray 27 of the finisher 25 via a pair of ejection rollers 13 and the sheet conveying device 30.

Figure 2:
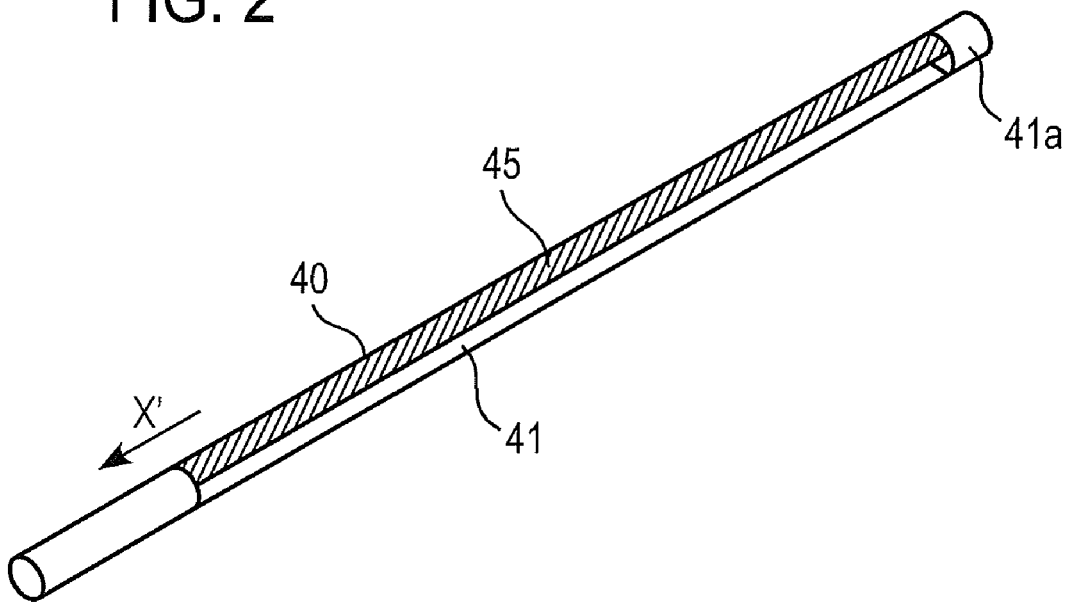
FIG. 2 is a perspective view of a jam treater.

The sheet conveying device 30 comprises a housing 31, conveyer rollers 32, 33 and 34 for conveying sheets one by one, guide plates 35 and 36 for guiding a sheet by regulating the front side and the back side of the sheet, and a jam treater, located between the conveyer rollers 32 and 33, for treating a paper jam. The jam treater 40 is a stick with a circular cross section and has a slit-like space 41 in which a sheet is guided as shown in FIG. 2. The guide plates 35 and 36 have curved portions 35*a* and 36*a*, respectively. The jam treater 40 is set in a bulged portion formed of the curved portions 35*a* and 36*a* so as to be rotatable therein, and the jam treater 40 is detachable from the housing 31. When the jam treater 40 is set in the housing 31 as shown by FIG. 1, the space 41 thereof serves as a part of the sheet path.

Sheet sensors 51, 52, 53 and 54 are provided in the sheet path. The sensors 53 and 54 are located near the jam treater 40, in positions respectively upstream and downstream from the jam treater 40 with respect to a sheet traveling direction. The sensor 51 is located near the rollers 32, that is, at a position upstream from the jam treater 40 with respect to the sheet traveling direction. The sensor 52 is located near the rollers 33, that is, at a position downstream from the jam treater 40 with respect to the sheet traveling direction. The sensors 51 to 54 may be a non-contact optical type or may be a contact type with an actuator.

Figure 3A:
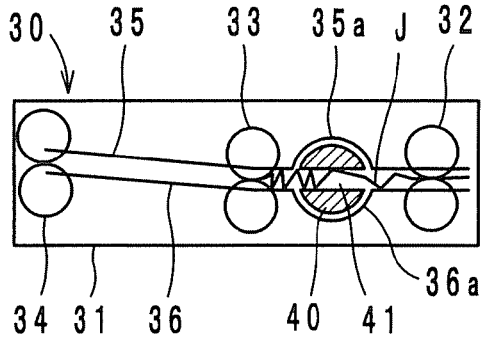
FIGS. 3*a*-3*c* are illustrations showing steps of treating a paper jam.

A sheet ejected from the printer body 10 via the ejection rollers 13 is received by the rollers 32. Then, the sheet travels in the space 41 of the jam treater 40 and is further conveyed to the finisher 25 via the rollers 33 and 34. The jam treater 40 usually serves as a sheet guide. When a paper jam occurs in the sheet conveying device 30, a jammed sheet is partly in the space 41 of the jam treater 40. FIG. 3*a* shows a state of paper jam, and the reference mark "J" denotes the jammed sheet. When the sensor 52 does not detect a sheet even a specified time after the sensor 51 detects a sheet, it is judged that a paper jam has occurred.

Figure 3B:
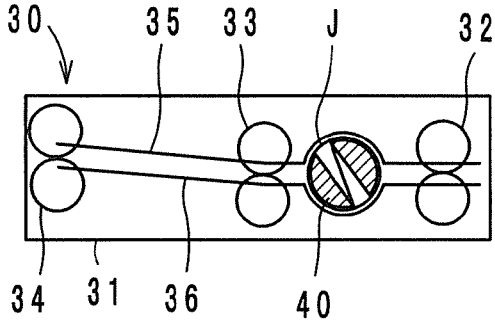
Figure 3C:
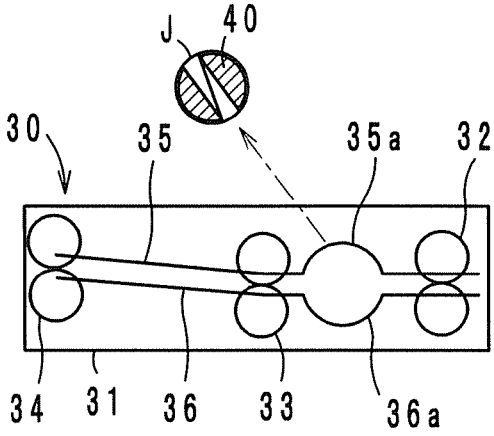

In case of a paper jam, an operator rotates the jam treater 40 by hand to wind the jammed sheet J around the sheet treater 40 (see FIG. 3*b*). Then, the operator takes the jam treater 40 wounded with the jammed sheet J out of the housing 31 (specifically, draws the jam treater 40 along the axial direction), and thus, the jammed sheet J can be removed from the sheet conveying device 30 easily (see FIG. 3*c*). When the sensors 53 and 54 provided near the jam treater 40 no longer detect the sheet J, it is judged that winding of the jammed sheet J around the jam treater 40 has been completed. For example, by displaying the detection states of the sensors 53 and 54 on a liquid crystal display in an operation panel or by turning on a lamp 61 (see FIG. 1), it is possible to inform the operator that the winding of the jammed sheet S is completed. After the jammed sheet J is peeled off the jam treater 40, the jam treater 40 is reset in the sheet conveying device 30.

Thus, such a simple structure for jam treatment, that is, the jam treater 40 that is rotatable and that can be drawn out of the housing 31 facilitates an operator to remove a jammed sheet from the sheet conveying device 30.

Further, because of the sheet sensors 53 and 54 near the jam treater 40 and because of the lamp 61 for notifying the detection states of the sensors 53 and 54, the operator can get information whether the jammed sheet J has been completely wound around the jam treater 40. Thereby, there is no possibility that the jam treater 40 may be drawn with the winding of the jammed sheet J incomplete, and trouble that the jammed sheet J may be torn and may be partly left in the sheet path is avoided.

Figure 4:
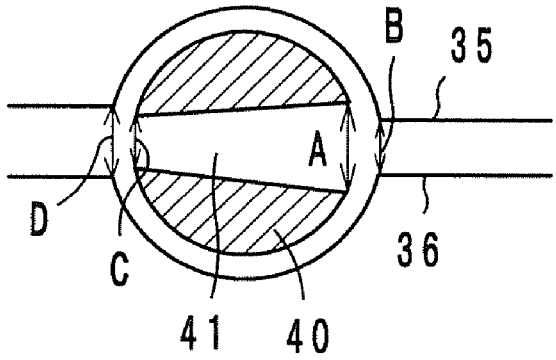
FIG. 4 is a sectional view of a modified jam treater.

As shown by FIG. 4, when the open side of the space 41 of the jam treater 40 at the upstream side with respect to the sheet conveying direction is referred to as a first open side, the first open side is larger than the opposite open side formed by the guides 35 and 36 (A>B). Moreover, when the open side of the space 41 of the jam treater 40 at the downstream side with respect to the sheet conveying direction is referred to as a second open side, the second open side is smaller than the opposite open side formed by the guides 35 and 36 (C<D). This arrangement prevents a sheet from being hooked by the joints of the sheet path and contributes to smooth travel of a sheet.

Figure 5:
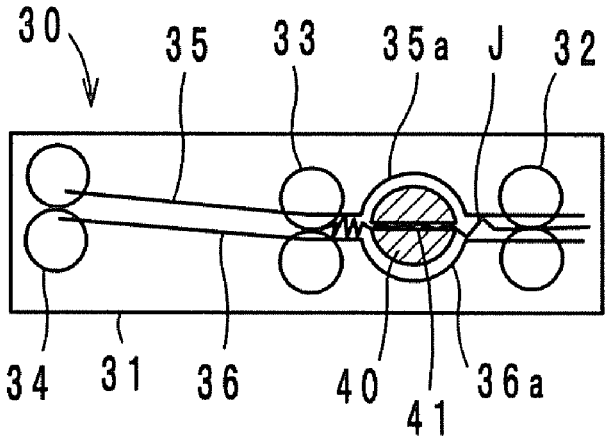
FIG. 5 is a sectional view of a sheet conveying device provided with a jam treater with a variable space.

The space 41 of the jam treater 40 may be variable. While the jam treater 40 serves as a sheet guide, the space 41 may be kept wide. When the jam treater 40 serves to remove a jammed sheet J, the space 41 may be set narrow as shown by FIG. 5. Thereby, the jammed sheet is nipped in the space 41 and can be surely wound around the jam treater 40, and accordingly, the jammed sheet J can be surely removed.

Figure 6:
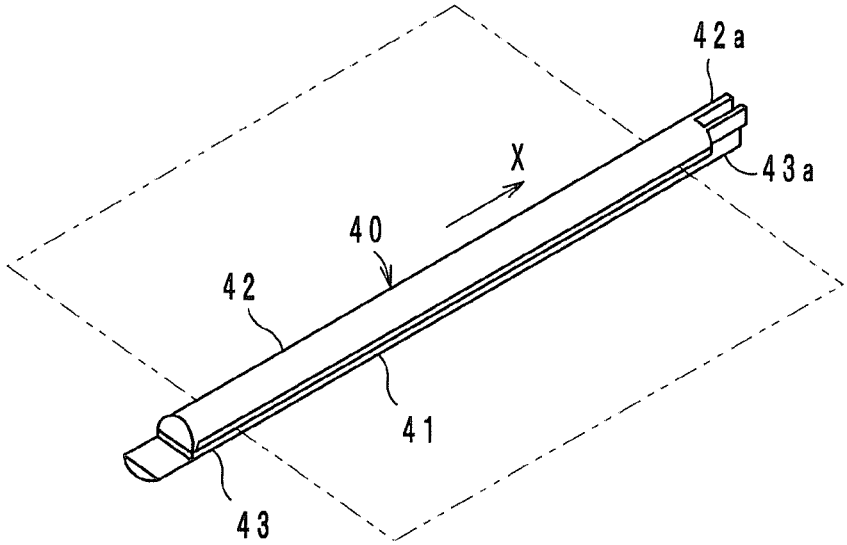
FIG. 6 is a perspective view of the jam treater with a variable space.
Figure 7A:
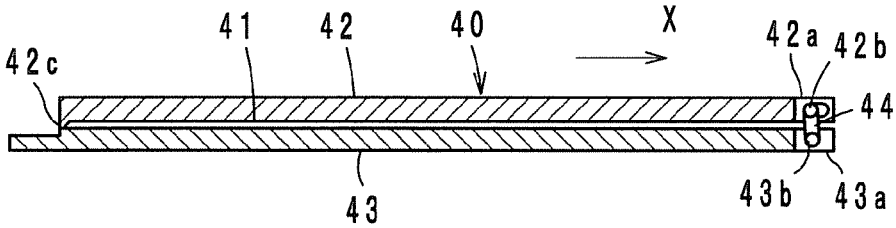
FIGS. 7*a* and 7*b* are sectional views of the jam treater with a variable space.
Figure 7B:
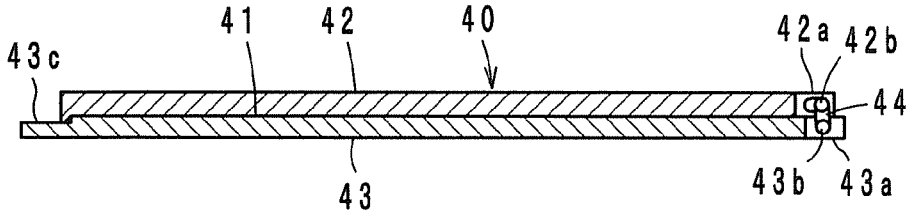

More specifically, as shown by FIGS. 6, 7*a* and 7*b*, the jam treater 40 has two sticks 42 and 43. Pins 42*b* and 43*b* are provided respectively at ends 42*a* and 43*a* of the sticks 42 and 43, and a link 44 connects the pins 42*b* and 43*b* with each other. The stick 42 is urged by a torsion spring (not shown) in a direction shown by an arrow "X".

As FIG. 7*a* shows, usually, the stick 42 is urged by the torsion spring in the direction "X", and accordingly, a notch 42*c* of the stick 42 stays on an upper level of the other stick 43. Thereby, the space 41 is maintained. When the jam treater 40 serves to remove a jammed sheet, on the other hand, the stick 42 is pulled in a direction opposite to the direction "X", the notch 42*c* of the stick 42 falls down to a lower level 43*c* of the stick 43. Thereby, the space 41 vanishes, and the sticks 42 and 43 nip the jammed sheet therebetween.

As shown by FIG. 2, the jam treater 40, after being wound with the jammed sheet, is drawn in the direction "X". In this moment, the jam treater 40 has no space at the upstream end 41*a* with respect to the drawing direction. Since the end 41*a* of the jam treater 40 has no space, the jammed sheet can be surely taken out of the sheet path together with the jam treater 40. The same effect can be achieved by providing the jam treater 40 with an antislipping member 45 for preventing a jammed sheet from slipping therefrom, and specifically, by providing a member 45 with a high coefficient of friction on the circumference of the jam treater 40.

Figure 8A:
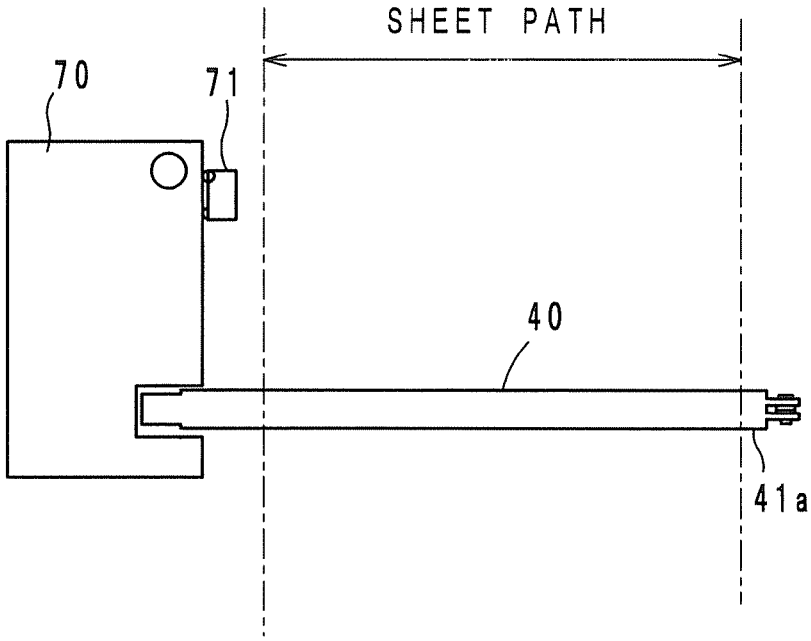
FIGS. 8*a* and 8*b* are plan views of a sensor for detecting the jam treater in a set position.
Figure 8B:
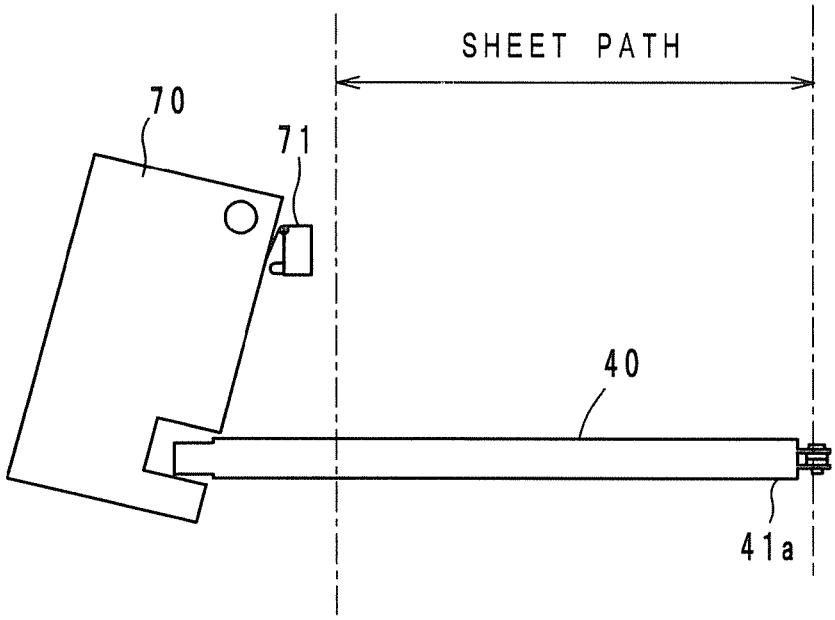

As shown by FIGS. 8*a* and 8*b*, the sheet conveying device 30 further has a front cover 70 in front of the jam treater 40 and a sensor 71 for detecting the cover 70 in a closed position. FIG. 8*a* shows a state, wherein the front cover 70 is closed to keep the jam treater 40 in a usual position. In this state, the sensor 71 is on, which indicates that the front cover 70 is closed, that is, that the jam treater 40 is in a set position to guide a sheet.

In removing a jammed sheet, an operator opens the front cover 70 and draws the jam treater 40. In this moment, the sensor 71 is turned off. After the jammed sheet is removed, the jam treater 40 is returned to the set position. If the jam treater 40 is not completely reset, the front cover 70 cannot be closed completely, and accordingly, the sensor 71 is not turned on (see FIG. 8*b*).

When the jam treater 40 is not completely reset, as shown by FIG. 8*b*, an end 41*a* of the jam treater 40 will be an obstacle in the sheet path, which will cause a paper jam. In order to avoid this trouble, after jam treatment is performed, only when the sensor 71 is turned on again, the printer body 10 allows conveyance of a sheet. The printer body 10 has a control section 15 (see FIG. 1) for controlling a print operation, and information on the sheet conveying device 30, such as a signal from the sensor 71, etc., is sent to the control section 15.

Thus, only when the sensor 71 detects that the jam treater 40 is completely reset, conveyance of a sheet is allowed. Therefore, a paper jam caused by incomplete reset of the jam treater 40 after jam treatment is prevented.

Figure 9:
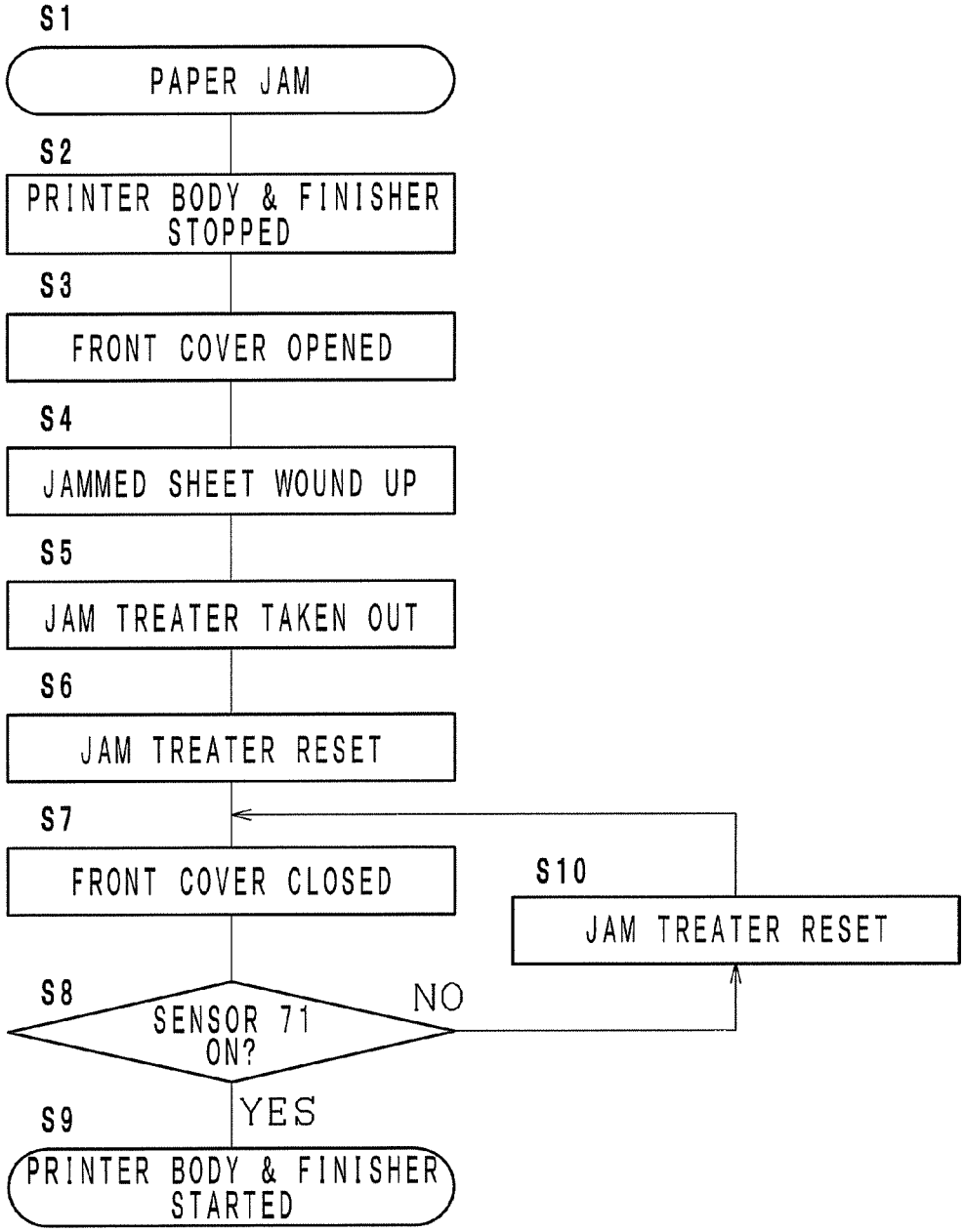
FIG. 9 is a flowchart showing a control procedure using the sensor.

FIG. 9 shows a control procedure for treating a paper jam, including the operator's tasks. When the control section 15 detects occurrence of a paper jam (step S1), the printer body 10 and the finisher 25 are stopped (step S2), and the occurrence of a paper jam is displayed. The operator opens the front cover 70 (step S3), rotates the jam treater 40 to wind a jammed sheet therearound (step S4) and draws the jam treater 40 out of the housing 31 (step S5). Then, after peeling the jammed sheet from the jam treater 40, the operator resets the jam treater 40 in the housing 31 (step S6) and closes the front cover 70 (step S7). At this time, when the sensor 71 is turned on (YES at step S8), the printer body 10 and the finisher 25 are started (step S9). On the other hand, when the sensor 71 is off (NO at step S8), the operator opens the front cover 70 to reset the jam treater 40 again (step S10). When the sensor 71 is not turned on after jam treatment, a notice may be displayed on the liquid crystal display in the operation panel, or an alarm may be made by turning on the light 62 (see FIG. 1).

Figure 10:
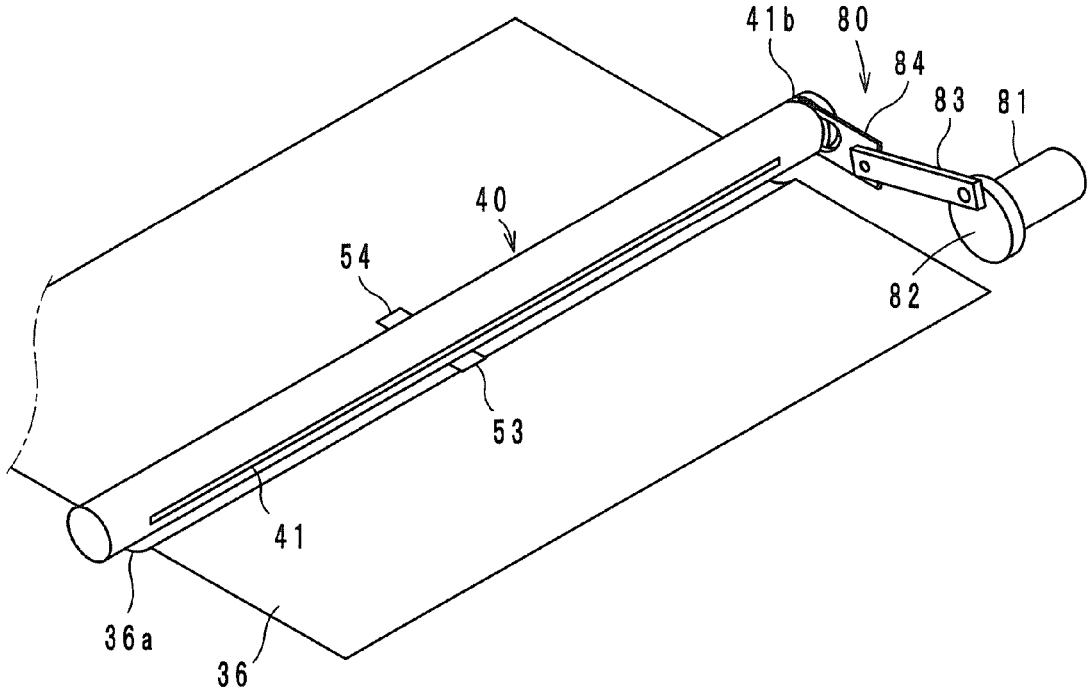
FIG. 10 is a perspective view of a lock mechanism for locking the jam treater.

Next, referring to FIG. 10, a lock mechanism 80 for the jam treater 40 is described. This lock mechanism 80 is to lock and unlock the jam treater 40 in and from the housing 31. The lock mechanism 80 comprises a motor 81, a cam 82 fitted to a rotary shaft of the motor 81, a stopper 84 and a link 83 connecting the cam 82 to the stopper 84. One end of the link 83 is fitted to an eccentric portion of the cam 82, and the other end thereof is fitted to the stopper 84. The stopper 84 gets into and out of a groove 41*b* made in an end portion of the jam treater 40 in accordance with rotation of the motor 81. When the stopper 84 gets into the groove 41*b*, the stopper 84 prevents the operator from drawing the jam treater 40 out of the housing 31. When the stopper 84 gets out of the groove 41*b*, the stopper 84 permits the operator to draw the jam treater 40 out of housing 31. Meanwhile, around the jam treater 40, the sensors 53 and 54 operate to detect a sheet.

Figure 11:
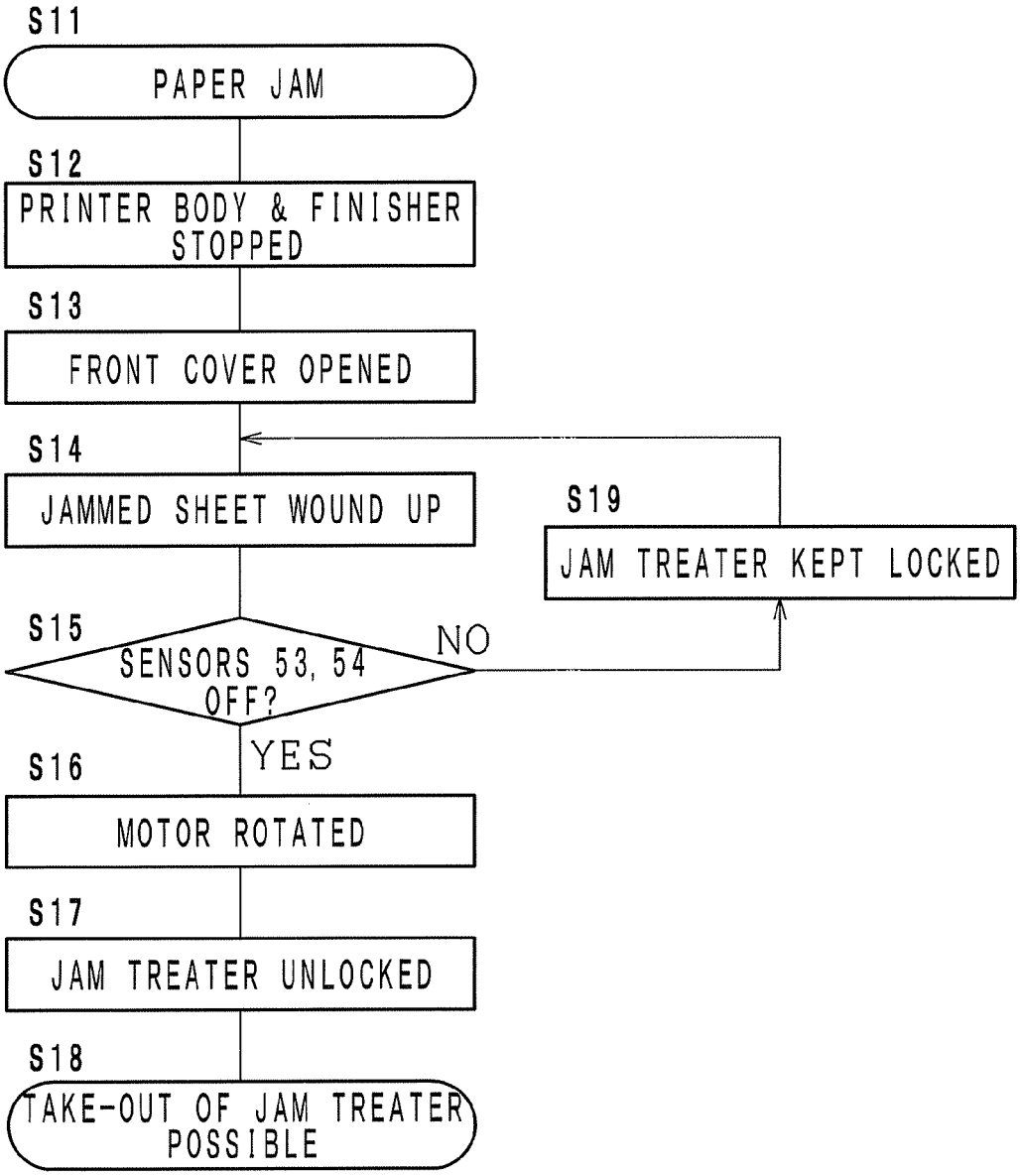
FIG. 11 is a flowchart showing a control procedure using the lock mechanism.

The control section 15 carries out a control procedure using the lock mechanism 80. FIG. 11 shows the control procedure, including the operator's tasks. The stopper 84 is usually set to get into the groove 41*b*. When the control section 15 recognizes occurrence of a paper jam (step S11), the control section 15 stops operations of the printer body 10 and the finisher 25 (step S12) and informs the operator that a paper jam has occurred. The operator opens the front cover 70 (step S13) and rotates the jam treater 40 to wind a jammed sheet around the jam treater 40 (step S14). Meanwhile, it is judged based on signals from the sensors 53 and 54 whether the jammed sheet is completely wound up. When the sensors 53 and 54 are turned off (YES at step S15), it is judged that the jammed sheet has been completely wound up. Then, the motor 81 is rotated at a specified amount (step S16) so as to move the stopper 84 out of the groove 41*b*, that is, to unlock the jam treater 40 (step S17). Thus, it becomes possible to draw the jam treater 40 out of the housing 31 (step S18). On the other hand, unless the sensors 53 and 54 are turned off (No at step S15), it is judged that the jammed sheet has not been completely wound up around the jam treater 40, and the jam treater 40 is kept locked (step S19). Then, the operator continues rotating the jam treater 40 to wind the jammed sheet.

The control procedure using the lock mechanism 80 prohibits the operator from drawing the jam treater 40 out of the housing 31 with the jammed sheet incompletely wound therearound and accordingly prevents a problem that a torn piece of the jammed sheet is left in the sheet path.

Figure 12:
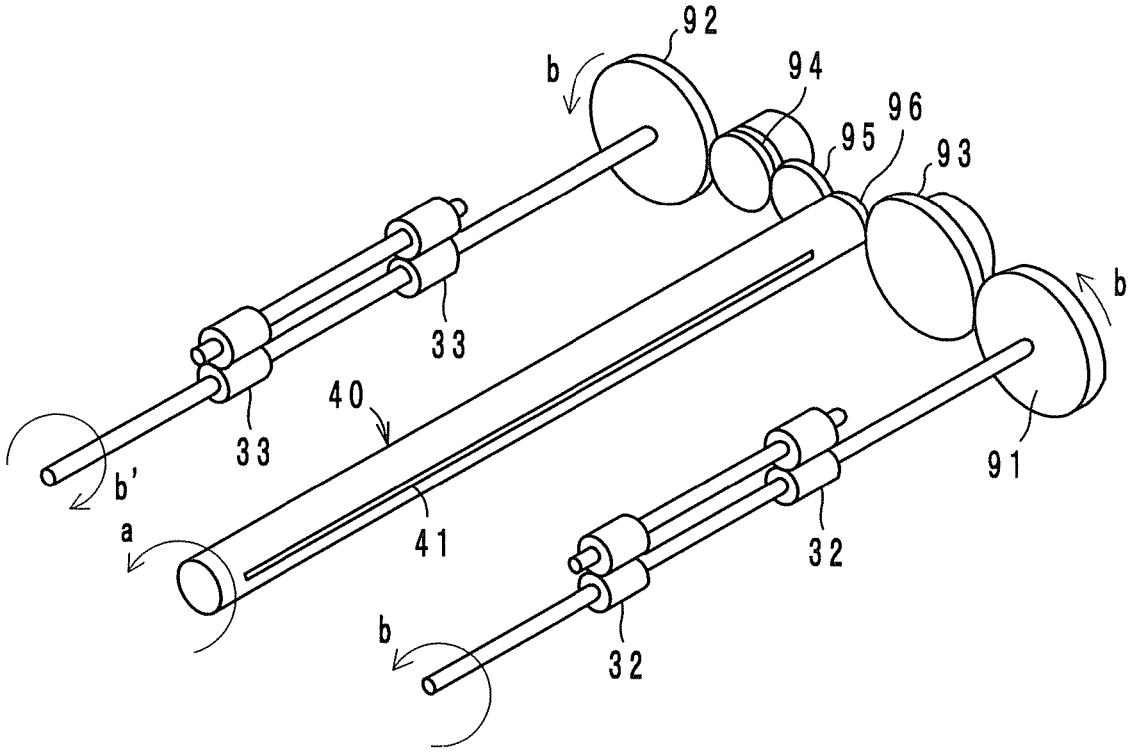
FIG. 12 is a perspective view of a drive mechanism for driving the conveyer rollers.

In the sheet conveying device 30, as shown by FIG. 12, gears 91 and 92 serving as a drive mechanism for driving the pairs of rollers 32 and 33 respectively may be connected to a gear 96 attached to an end of the jam treater 40 via gears 93, 94 and 95. The gear 96 is a one-way gear. Only when the jam treater 40 is rotated in a direction shown by arrow "a", the gear 96 rotates and transmits the rotation to the gears 93 and 95. The gear 96, however, does not transmit the rotations of the gears 93 and 95 to the jam treater 40.

During sheet conveyance, the driving gears 91 and 92 rotate in a direction shown by arrow "b" so that the rollers 32 and 33 can feed a sheet. In this state, the gear 96 idles, and the jam treater 40 does not rotate. When an operator rotates the jam treater 40 in the direction "a" so as to treat a paper jam, the rotation of the jam treater 40 is transmitted to the gear 91 via the one-way gear 96 and the gear 93 and also to the gear 92 via the gears 94 and 95. Accordingly, the rollers 32 rotate in the direction "b" and the rollers 33 rotate in a direction shown by arrow "b'".

Thus, during jam treatment, the rollers 32 and 33 rotate in directions to feed a jammed sheet to the jam treater 40, and the jammed sheet can be prevented from being tense between the rollers 32 and the rollers 33 and from being torn.

SUMMARY OF THE EMBODIMENTS

In the sheet conveying device, the space in the jam treater has a first open side at an upstream side with respect to a sheet traveling direction, and the first open side is preferably larger than an open side of the sheet guide opposite thereto. Also, the space of the jam treater has a second open side at a downstream side with respect to the sheet traveling direction, and the second open side is preferably smaller than an open side of the sheet guide opposite thereto. With this arrangement, a sheet can be guided and conveyed smoothly.

The jam treater may comprise at least two sticks, and the space in the jam treater may be variable. When the jam treater serves to guide a sheet, the space is wide. When the jam treater treats a paper jam, on the other hand, the space becomes narrow to nip a jammed sheet. Thereby, the jammed sheet can be securely wound around the jam treater and can be taken out of the device body together with the jam treater. Alternatively, the jam treater may have an antislipping member so as to achieve the same effect.

The sheet conveying device may further comprise: a sensor for detecting the jam treater in a specified position to guide a conveyed sheet; and a controller for permitting sheet conveying only when the jam treater is in the specified position. With this arrangement, there is no possibility that a paper jam may be caused by an incomplete reset of the jam treater after removal of a jammed sheet.

The sheet conveying device may further comprise: a sensor for detecting a sheet around the jam treater; and a display for displaying information detected by the sensor. This arrangement informs the operator whether the jammed sheet has been completely wound around the jam treater, and the operator will not draw the jam treater before winding up the jammed sheet around the jam treater. Therefore, trouble that a torn piece of jammed sheet may be left in the sheet path is avoided.

Alternatively, the sheet conveying device may further comprise: a sensor for detecting a sheet around the jam treater; a lock mechanism for locking and unlocking the jam treater in and from the device body; and a controller for controlling the lock mechanism to unlock the jam treater when the sensor does not detect a sheet. With this arrangement, the jam treater cannot be drawn until the sensor stops detecting a sheet (that is, until the jammed sheet is completely wound around the jam treater). Thereby, the operator is prohibited from drawing the jam treater before winding up the jammed sheet around the jam treater, and trouble that a torn piece of jammed sheet may be left in the sheet path is avoided.

In the sheet conveying device, a drive mechanism for driving the conveyer roller is connected to the jam treater only for treatment of a paper jam so that the conveyer roller can feed a jammed sheet to the jam treater with rotation of the jam treater. In the structure, when the jam treater is rotated for treatment of a paper jam, the conveyer roller feeds the jammed sheet to the jam treater, and there is no possibility that the jammed sheet may become tense between the jam treater and the conveyer roller and may be torn.

Other Embodiments

The structures of the sheet guides and the conveyer rollers of the sheet conveying device can be designed arbitrarily, and the detailed construction of the jam treater can be designed arbitrarily.

Although the present invention has been described in connection with the preferred embodiments above, it is to be noted that various changes and modifications are possible to those who are skilled in the art. Such changes and modifications are to be understood as being within the present invention.

What is claimed is:

1. A sheet conveying device comprising:

a device body;

a conveyer roller for conveying sheets one by one;

a jam treater having a space in which a sheet is guided, the jam treater being rotatable and being detachable from the device body;

a sheet guide for regulating a front side and a back side of a conveyed sheet, the sheet guide having a bulged portion in which the jam treater is rotatable;

a sensor for detecting the jam treater in a specified position to guide a conveyed sheet; and a controller for permitting sheet conveyance only when the jam treater is in the specified position.

2. A sheet conveying device according to claim 1, wherein the space in the jam treater has a first open side at an upstream side with respect to a sheet traveling direction, the first open side being larger than an open side of the sheet guide opposite thereto; and wherein the space of the jam treater has a second open side at a downstream side with respect to the sheet traveling direction, the second open side being smaller than an open side of the sheet guide opposite thereto.

3. A sheet conveying device according to claim 1, wherein the jam treater comprises at least two sticks; and wherein the space in the jam treater is variable.

4. A sheet conveying device according to claim 1, wherein the jam treater has an antislipping member.

5. A sheet conveying device according to claim 1, further comprising:

a sensor for detecting a sheet around the jam treater; and a display for displaying information detected by the sensor.

6. A sheet conveying device according to claim 1, further comprising:

a sensor for detecting a sheet around the jam treater;

a lock mechanism for locking and unlocking the jam treater in and from the device body; and a controller for controlling the lock mechanism to unlock the jam treater when the sensor does not detect a sheet.

7. A sheet conveying device comprising:

a device body;

a conveyer roller for conveying sheets one by one;

a jam treater having a space in which a sheet is guided, the jam treater being rotatable and being detachable from the device body;

a sheet guide for regulating a front side and a back side of a conveyed sheet, the sheet guide having a bulged portion in which the jam treater is rotatable; and a drive mechanism for driving the conveyor roller, wherein the drive mechanism for driving the conveyer roller is connected to the jam treater only for treatment of a paper jam so that the conveyer roller can feed a jammed sheet to the jam treater with rotation of the jam treater.

8. A sheet conveying device according to claim 1, further comprising a drive mechanism for driving the conveyer roller, wherein the drive mechanism for driving the conveyer roller is connected to the jam treater only for treatment of a paper jam so that the conveyer roller can feed a jammed sheet to the jam treater with rotation of the jam treater.

9. A sheet conveying device according to claim 3, wherein the jam treater comprises:

a first stick with a groove at one end and a first pin at the other end; and a second stick with a notch protruding from the second stick at one end and a second pin at the other end, wherein the first pin and second pin are linked together, wherein, in a first position, the notch rests on the first stick adjacent to the groove to create the space, and wherein, in a second position, the locking element rests in the groove to reduce the size of the space.

10. A sheet conveying device according to claim 4, wherein the antislipping member is a member with a high coefficient of friction on the circumference of the jam treater.

11. A sheet conveying device according to claim 1, wherein the jam treater has only one stick; and wherein the space in the jam treater is not adjustable.

* * * * *